US010992068B2

(12) United States Patent
Suzuki et al.

(10) Patent No.: US 10,992,068 B2
(45) Date of Patent: Apr. 27, 2021

(54) METHOD FOR MANUFACTURING SOLDER WITH GROUND BAR AND COAXIAL CABLE ARRAY

(71) Applicant: HITACHI METALS, LTD., Tokyo (JP)

(72) Inventors: Kanako Suzuki, Tokyo (JP); Mikio Okoshi, Tokyo (JP); Yohei Shirakawa, Tokyo (JP); Yoshitake Ageishi, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/788,147

(22) Filed: Feb. 11, 2020

(65) Prior Publication Data

US 2020/0266559 A1 Aug. 20, 2020

(30) Foreign Application Priority Data

Feb. 14, 2019 (JP) ..... JP2019-024398

(51) Int. Cl.
*H01R 4/02* (2006.01)
*H01R 9/05* (2006.01)

(52) U.S. Cl.
CPC ..... *H01R 9/0512* (2013.01); *H01R 4/029* (2013.01)

(58) Field of Classification Search
CPC . H01R 4/029; H01R 4/02; H01R 9/02; H01R 9/0512; H01R 4/021; H01R 4/022; H01R 4/024; H01R 9/03; H01R 9/07; H01R 9/0707; H01R 9/0778
USPC ..... 174/74 R, 78, 84 R, 88 R
See application file for complete search history.

(56) References Cited

U.S. PATENT DOCUMENTS 5,241,135 A * 8/1993 Fetzer ..... H01R 9/0512 174/88 R
5,281,762 A * 1/1994 Long ..... H01R 9/0515 174/117 F
6,031,185 A * 2/2000 Bouveret ..... H01R 4/646 174/84 R
6,326,548 B1 * 12/2001 Okumura ..... H01R 9/0512 174/88 C
6,734,374 B2 * 5/2004 Tang ..... H01R 9/0515 174/250
10,403,418 B2 * 9/2019 Aoyagi ..... H01B 11/203

FOREIGN PATENT DOCUMENTS

JP 2016-203217 A 12/2016

* cited by examiner

*Primary Examiner* — William H. Mayo, III
(74) *Attorney, Agent, or Firm* — Meunier Carlin & Curfman LLC

(57) ABSTRACT

A solder with ground bar includes a first unit and a second unit. The first unit includes a first ground bar and a first solder layer attached to one side of the first ground bar. The second unit includes a second ground bar and a second solder layer attached to one side of the second ground bar. The first unit and the second unit are arranged in such a manner that the first solder layer and the second solder layer face each other. The first solder layer and the second solder layer are partially joined together.

12 Claims, 7 Drawing Sheets

METHOD FOR MANUFACTURING SOLDER WITH GROUND BAR AND COAXIAL CABLE ARRAY

CROSS-REFERENCE TO RELATED APPLICATIONS

The present application claims the benefit of Japanese Patent Application No. 2019-024398 filed on Feb. 14, 2019 with the Japan Patent Office, the entire disclosure of which is incorporated herein by reference.

BACKGROUND

The present disclosure relates to a method for manufacturing a solder with ground bar and a coaxial cable array.

Japanese Unexamined Patent Application Publication No. 2016-203217 (Patent Document 1) discloses a technology as follows. A plurality of coaxial cables are juxtaposed. Each outer conductor of each of the coaxial cables is partially exposed. The exposed portions of the outer conductors of the plurality of coaxial cables are interposed between two ground bars. A solder sheet is attached to each ground bar. The solder sheet is molten in order to adhere the two ground bars to the plurality of coaxial cables.

SUMMARY

With the technology disclosed in Patent Document 1, the relative position between the two ground bars may shift.

One aspect of the present disclosure provides a method for manufacturing a solder with ground bar and a coaxial cable array in which the relative position between the two ground bars is less likely to shift.

One aspect of the present disclosure is a solder with ground bar that comprises a first unit including a first ground bar and a first solder layer that is attached to one side of the first ground bar, and a second unit including a second ground bar and a second solder layer that is attached to one side of the second ground bar, in which the first unit and the second unit are arranged in such a manner that the first solder layer and the second solder layer face each other, and the first solder layer and the second solder layer are partially joined together.

According to one aspect of the present disclosure, the solder with ground bar comprises the first solder layer and the second solder layer that are partially joined together. Accordingly, the relative position between the first unit and the second unit is less likely to shift when the solder with ground bar is used. Furthermore, it is unnecessary to adjust the relative position between the first unit and the second unit when the solder with ground bar is used.

Another aspect of the present disclosure is a method for manufacturing a coaxial cable array by attaching a ground bar to coaxial cables using a solder with ground bar. The solder with ground bar to be used comprises a first unit including a first ground bar and a first solder layer that is attached to one side of the first ground bar, and a second unit including a second ground bar and a second solder layer that is attached to one side of the second ground bar, in which the first unit and the second unit are arranged in such a manner that the first solder layer and the second solder layer face each other, and the first solder layer and the second solder layer are partially joined together.

According to another aspect of the present disclosure, in a method for manufacturing a coaxial cable array, exposed portions of outer conductors of the coaxial cables are inserted between the first unit and the second unit, and the first solder layer and the second solder layer are molten by heat to join the outer conductors with the ground bars.

According to another aspect of the present disclosure, in a method for manufacturing a coaxial cable array, a solder with ground bar, which is one of the aspects of the present disclosure, is used. Therefore, the relative position between the first unit and the second unit is less likely to shift. Furthermore, it is unnecessary to adjust the relative position between the first unit and the second unit.

BRIEF DESCRIPTION OF THE DRAWINGS

Some embodiments of the present disclosure will be described hereinafter by way of examples with reference to the accompanying drawings, in which.

DETAILED DESPRIPTION OF EXEMPLARY EMBODIMENTS

First Embodiment

1. Configuration of Solder 1 with Ground Bar

Figure 1:
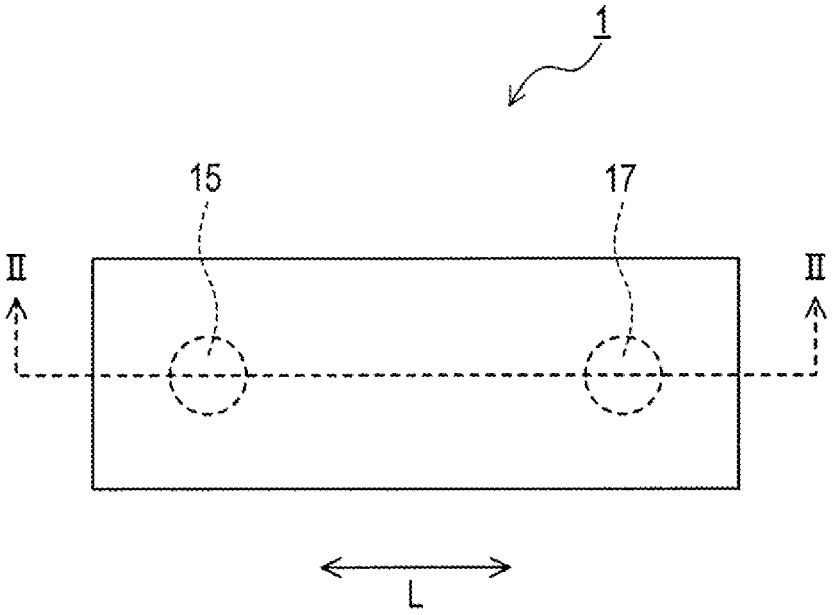
FIG. 1 is a plan view showing a configuration of a solder 1 with ground bar.
Figure 2:
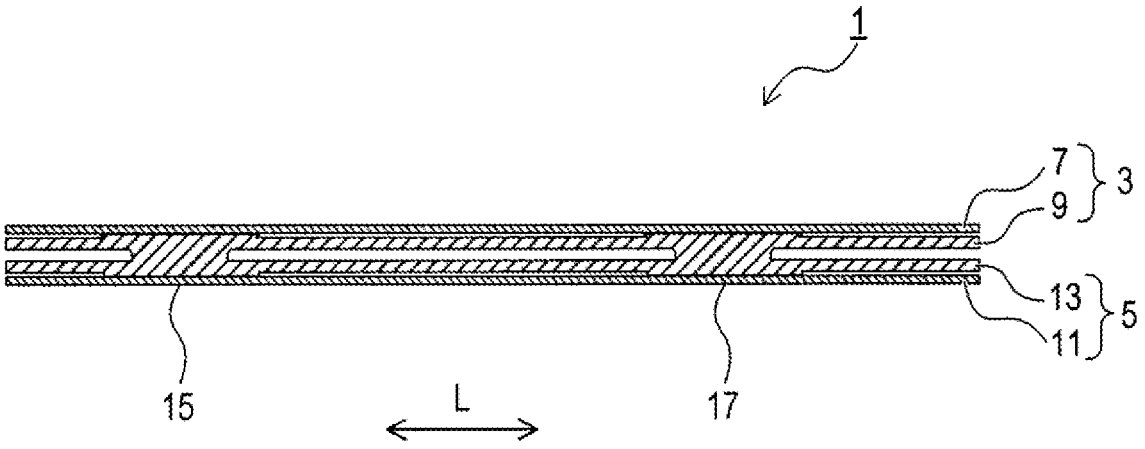
FIG. 2 is a sectional view in section II-II in FIG. 1.

A configuration of solder 1 with ground bar will be described by referring to FIG. 1 and FIG. 2. A basic form of a solder 1 with ground bar is, for example, a plate member being rectangle in a plan view. As shown in FIG. 2, the solder 1 with ground bar comprises a first unit 3 and a second unit 5.

The first unit 3 comprises a first ground bar 7 and a first solder layer 9. The first ground bar 7 is a rectangle-shaped plate member made of a metal. The metal can be, for example, copper. The first solder layer 9 is a layer made from solder. In the plan view, the first solder layer 9 is identical to the first ground bar 7 in shape. The first solder layer 9 faces one side of the first ground bar 7.

The first ground bar 7 and the first solder layer 9 are joined at a first joint point 15 and a second joint point 17. The first joint point 15 and the second joint point 17 are positions in the plan view. A center of the solder 1 with ground bar is positioned between the first joint point 15 and the second joint point 17 in the plan view.

The first joint point 15 and the second joint point 17 are arranged along a longitudinal direction L of the solder 1 with ground bar. The first joint point 15 and the second joint point 17 are provided apart from each other. The first ground bar 7 and the first solder layer 9 are joined together only at the first joint point 15 and the second joint point 17. The first solder layer 9 is joined to the first ground bar 7 at the first joint point 15 and the second joint point 17, whereby the first solder layer 9 is attached to the first ground bar 7.

The second unit 5 comprises a second ground bar 11 and a second solder layer 13. The second ground bar 11 is a member similar to the first ground bar 7. The second solder layer 13 is a member similar to the first solder layer 9. The second solder layer 13 faces one side of the second ground bar 11.

The second ground bar 11 and the second solder layer 13 are joined at the first joint point 15 and the second joint point 17. The second ground bar 11 and the second solder layer 13 are joined together only at the first joint point 15 and the second joint point 17. The second solder layer 13 is joined to the second ground bar 11 at the first joint point 15 and the second joint point 17, whereby the second solder layer 13 is attached to the second ground bar 11.

The first unit 3 and the second unit 5 are arranged so that the first solder layer 9 and the second solder layer 13 face each other. The first solder layer 9 and the second solder layer 13 are joined at the first joint point 15 and the second joint point 17. The first solder layer 9 and the second solder layer 13 are joined together only at the first joint point 15 and the second joint point 17. Specifically, the first solder layer 9 and the second solder layer 13 are partially joined together.

2. Method for Manufacturing the Solder 1 with Ground Bar

A method for manufacturing the solder 1 with ground bar will be described by referring to FIG. 3. The solder 1 with ground bar may be manufactured using a production machine 19 shown in FIG. 3. The configuration of the production machine 19 will be described below. The production machine 19 comprises a first feed roll 21, a second feed roll 23, a third feed roll 25 and a fourth feed roll 27.

The first ground bar 7, which is a long strip, is wound about the first feed roll 21. The second ground bar 11, which is a long strip, is wound about the second feed roll 23. A thread solder 29 is wound about the third feed roll 25. A thread solder 31 is wound about the fourth feed roll 27.

The production machine 19 comprises a roller 33, a roller 35 and a roller 37. The rollers 33, 35 and 37 guide the first ground bar 7 withdrawn from the first feed roll 21 to a roller 65 and a roller 67, which will be described below. The production machine 19 comprises a roller 39, a roller 41 and a roller 43. The rollers 39, 41 and 43 guide the second ground bar 11 withdrawn from the second feed roll 23 to the rollers 65 and 67.

The production machine 19 comprises a roller 45, a roller 47 and a roller 49. The rollers 45, 47 and 49 guide the thread solder 29 withdrawn from the third feed roll 25 to the rollers 65 and 67. The production machine 19 comprises a roller 51, a roller 53 and a roller 55. The rollers 51, 53 and 55 guide the thread solder 31 withdrawn from the fourth feed roll 27 to the rollers 65 and 67.

The production machine 19 comprises a rolling roller 57 and a rolling roller 59. The rolling rollers 57 and 59 roll the thread solder 29 to produce the first solder layer 9. The production machine 19 comprises a rolling roll 61 and a rolling roll 63. The rolling rolls 61 and 63 roll the thread solder 31 to produce the second solder layer 13.

The production machine 19 comprises the rollers 65 and 67. The rollers 65 and 67 stack the first ground bar 7, the first solder layer 9, the second solder layer 13 and the second ground bar 11 in this order to form a laminate 75. The production machine 19 comprises a roller 69, a roller 71 and a gripper 73. The rollers 69 and 71 guide the laminate 75 to the gripper 73. The gripper 73 holds an end of the laminate 75.

The production machine 19 comprises a heater 77 and a heater 79. The heaters 77 and 79 are provided at positions closer to the rollers 65 and 67 than the rollers 69 and 71. The heaters 77 and 79 are spaced apart from each other along a longitudinal direction of the laminate 75. The heaters 77 and 79 heat the laminate 75 from both sides along a thickness direction of the laminate 75. An area the heaters 77 and 79 heat is smaller than a width of the laminate 75.

The production machine 19 comprises a collection box 81. The collection box 81 is provided under the laminate 75 and between the heater 79 and the position where the rollers 69 and 71 are provided. The collection box 81 is a box with a top thereof opened.

A method for manufacturing the solder 1 with ground bar using the production machine 19 will be described. The first ground bar 7 is withdrawn from the first feed roll 21. The second ground bar 11 is withdrawn from the second feed roll 23. The thread solder 29 is withdrawn from the third feed roll 25 and rolled by the rolling rollers 57 and 59 to produce the first solder layer 9. The thread solder 31 is withdrawn from the fourth feed roll 27 and rolled by the rolling rolls 61 and 63 to produce the second solder layer 13.

The first ground bar 7, the first solder layer 9, the second solder layer 13, and the second ground bar 11 are stacked in this order by the rollers 65 and 67 to form the laminate 75. The laminate 75 is passed through the heaters 77 and 79 and then fed out to the gripper 73. The end of the laminate 75 is held by the gripper 73.

Subsequently, the laminate 75 is heated at two points for a predetermined time using the heaters 77 and 79 and then cooled. The two heated points make the first joint point 15 and the second joint point 17, respectively. At each of the first joint point 15 and the second joint point 17, the first solder layer 9 and the second solder layer 13 melt and then solidify.

Figure 3:
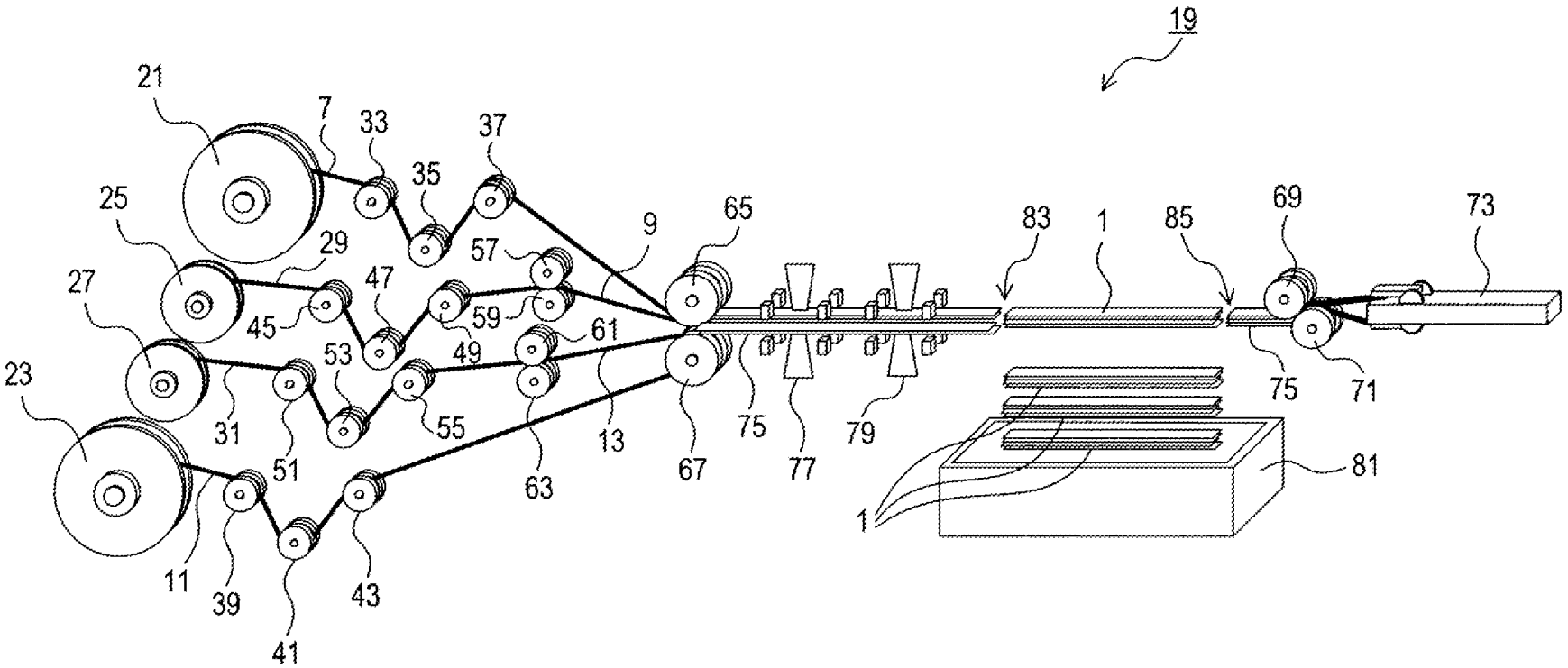
FIG. 3 is a schematic view illustrating a configuration of a production machine 19 and a method for manufacturing a solder 1 with ground bar.

The gripper 73 is then moved to the right side in FIG. 3 to move a portion of the laminate 75 in which the first joint point 15 and the second joint point 17 are formed to a position above the collection box 81. The laminate 75 is then cut off at a cutting position 83 and a cutting position 85. The cut laminate 75 makes the solder 1 with ground bar. The solder 1 with ground bar falls down into the collection box 81.

Subsequently, the end of the laminate 75 is held at the cutting position 83 by the gripper 73. The gripper 73 is then returned to a position indicated in FIG. 3. Consequently, a newly produced laminate 75 is moved to a position corresponding to the heaters 77 and 79.

Although it has been described in the above that the solder 1 with ground bar is individually produced by cutting off a portion of the laminate 75 including the first joint point 15 and the second joint point 17, a long solder with ground bar may be produced without cutting the laminate 75. The long solder with ground bar is in a form of a plurality of the connected solders with ground bar 1 shown in FIG. 1. A coaxial cable array 117 may be manufactured, using the long solder with ground bar, by the same method for manufacturing the coaxial cable array as those in embodiments described below.

3. Method for Manufacturing Coaxial Cable Array

A method for manufacturing a coaxial cable array will be described by referring to FIGS. 4 to 6. As shown in S1 of FIG. 4, a fixing member 87 and a fixing member 89 are attached to the solder 1 with ground bar. The position where the fixing member 87 is attached is near an end 91 of the solder 1 with ground bar. The end 91 is one end in the longitudinal direction L. The fixing member 87 holds the solder 1 with ground bar from both sides along a thickness direction of the solder 1 with ground bar. A relative position of the fixing member 87 to the solder 1 with ground bar is constant.

The position where the fixing member 89 is attached is near an end 93 of the solder 1 with ground bar. The end 93 is an end opposed to the end 91. The fixing member 89 holds the solder 1 with ground bar from both sides along the thickness direction of the solder 1 with ground bar. A relative position of the fixing member 89 to the solder 1 with ground bar is constant.

While the fixing member 87 is kept in a position, the fixing member 89 is moved in A-direction. During this period of time, the solder 1 with ground bar is subjected to a compression force acting along the longitudinal direction L. Consequently, as shown in S2 of FIG. 4, a space 94 between the first unit 3 and the second unit 5 expands within an area between the first joint point 15 and the second joint point 17.

Subsequently, as shown in S3 of FIG. 4, a plurality of coaxial cables 95 are inserted into the space 94. The plurality of coaxial cables 95 are sorts of multicore cables. The plurality of coaxial cables 95 are positioned between the first joint point 15 and the second joint point 17 in the longitudinal direction L. The plurality of coaxial cables 95 are provided in a row along the longitudinal direction L. An axial direction of the plurality of coaxial cables 95 is orthogonal to the longitudinal direction L and is orthogonal to the thickness direction of the solder 1 with ground bar.

Figure 5:
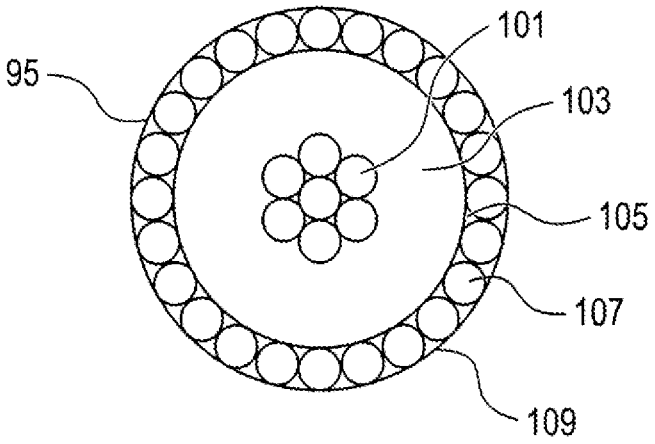
FIG. 5 is a sectional view showing a configuration of a coaxial cable 95.

As shown in FIG. 5, each of the plurality of coaxial cables 95 comprises inner conductors 101, an insulation layer 103, a first jacket 105, outer conductors 107, and a second jacket 109. The coaxial cables 95 have a diameter of, for example, 0.1 mm to 1 mm. A portion of the second jacket 109 of each of the plurality of coaxial cables 95 inserted between the first unit 3 and the second unit 5 is removed to expose the outer conductors 107.

The solder 1 with ground bar is heated using a heater 97 and a heater 99, and then cooled. The heaters 97 and 99 are arranged so as to hold the solder 1 with ground bar from both sides along the thickness direction of the solder 1 with ground bar. The heaters 97 and 99 press the first unit 3 and the second unit 5 toward the coaxial cables 95 while heating the solder 1 with ground bar. As the solder 1 with ground bar is heated by the heaters 97 and 99, the first solder layer 9 and the second solder layer 13 melt to produce a solder 111, as shown in S4 of FIG. 4. The molten solder 111 is pressed by the heaters 97 and 99, and spread between the first ground bar 7 and the second ground bar 11. The molten solder 111 is in contact with outer peripheral surfaces of the outer conductors 107 of the plurality of coaxial cables 95. As the solder 1 with ground bar is cooled, the solder 111 solidifies. The solder 111 joins the first ground bar 7, the second ground bar 11 and the outer conductors 107 mutually. The first ground bar 7, the second ground bar 11 and the outer conductors 107 are thus electrically connected. Before being heated by the heaters 97 and 99, the solder 1 with ground bar may be released from the holding with the fixing members 87 and 89. Also, before being heated by the heaters 97 and 99, the solder 1 with ground bar may be set free from the compression force acting in the longitudinal direction L.

Figure 4:
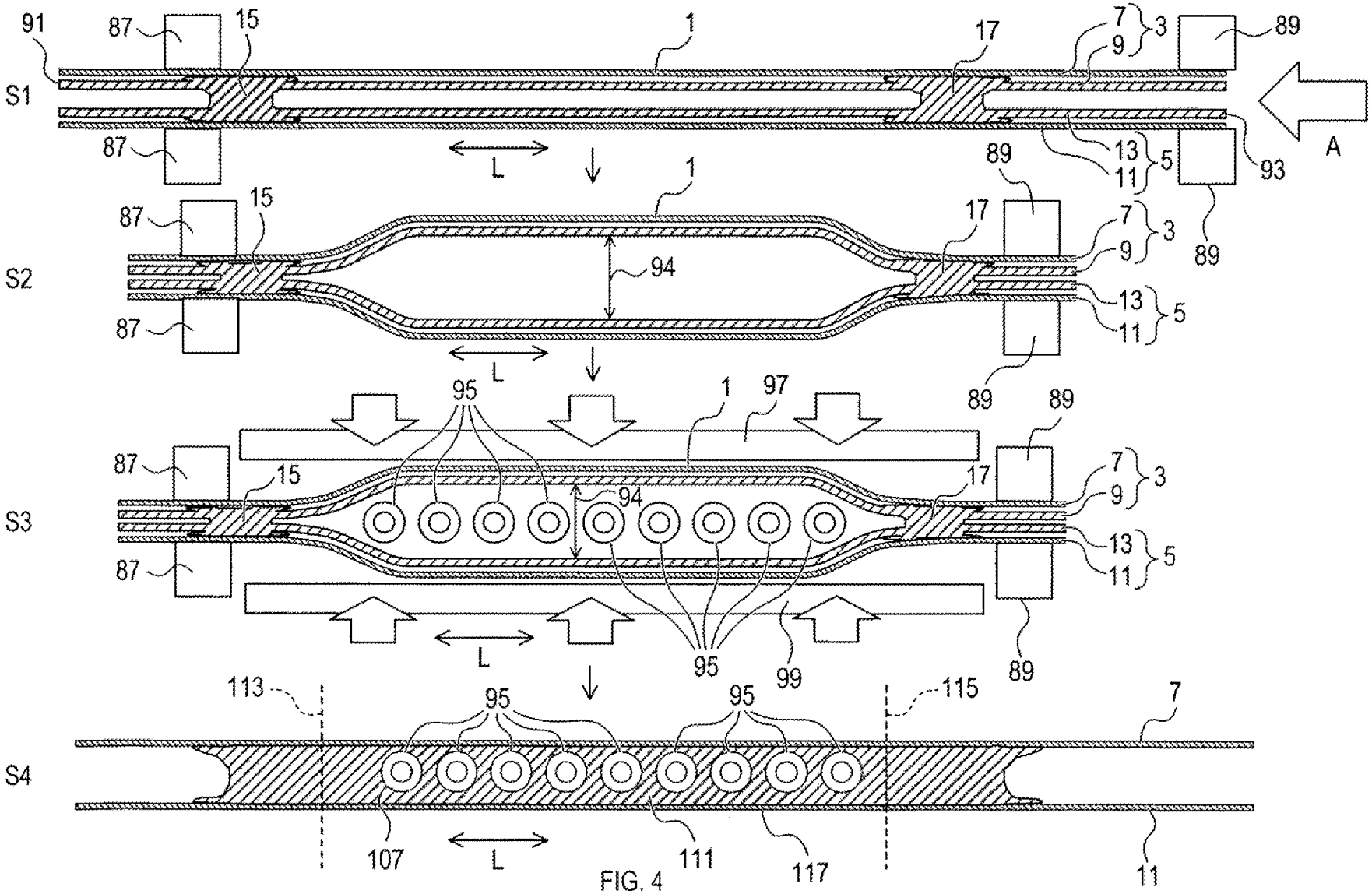
FIG. 4 is a schematic view illustrating a method for manufacturing a coaxial cable array.

Here, the first ground bar 7, the second ground bar 11 and the solder 111 are cut at a cutting position 113 and a cutting position 115 as shown in S4 of FIG. 4. After the above described procedures are all carried out, the coaxial cable array 117 is obtained. When there is plenty of space for wirings, a process to cut the coaxial cable array 117 at the cutting positions 113 and 115 may be omitted.

Figure 6:
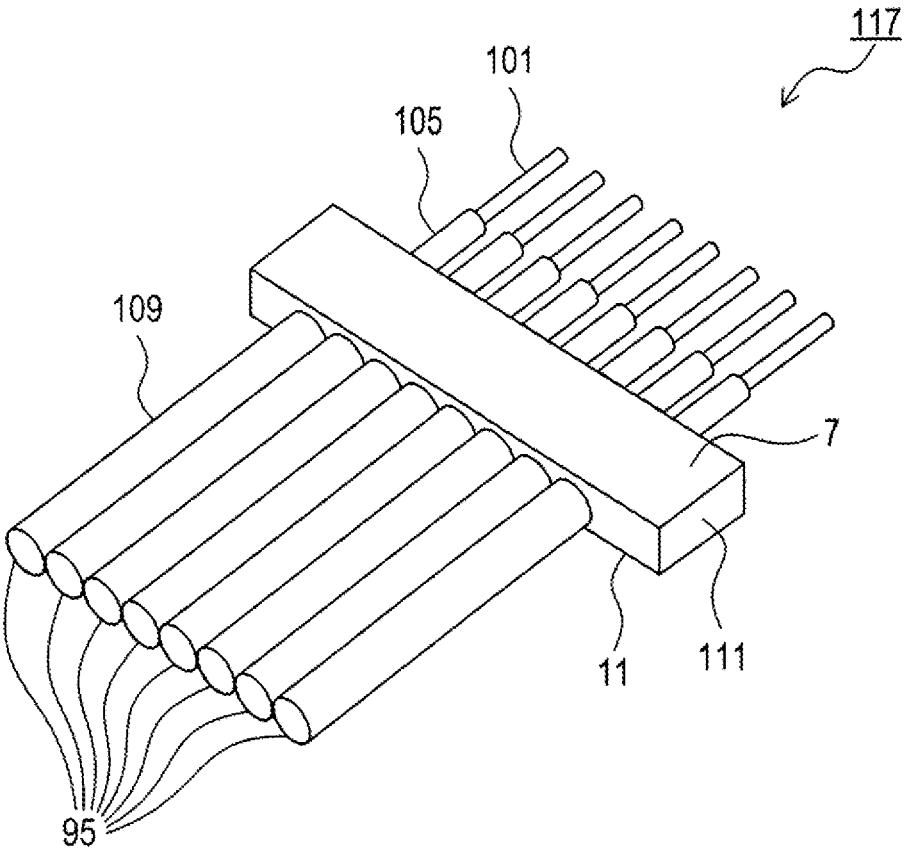
FIG. 6 is a perspective view showing a configuration of a coaxial cable array 117.

As shown in S4 of FIG. 4, and FIG. 6, the coaxial cable array 117 comprises the plurality of coaxial cables 95, the first ground bar 7, and the second ground bar 11. The first ground bar 7 and the second ground bar 11 are joined to the plurality of coaxial cables 95 through the solder 111.

Portions of the outer conductors 107 of the plurality of coaxial cables 95 positioned between the first ground bar 7 and the second ground bar 11 are exposed. The outer conductors 107 are electrically communicated with the first ground bar 7 and the second ground bar 11 through the solder 111.

As shown in FIG. 6, the first jackets 105 and the inner conductors 101 are partially exposed at the end of the plurality of coaxial cables 95. In the other parts of the coaxial cables 95, the second jackets 109 form outer peripheral surfaces of the coaxial cables 95.

4. Effects Obtained from Method for Manufacturing Solder 1 with Ground Bar and Coaxial Cable Array (1A) In the solder 1 with ground bar, the first solder layer 9 and the second solder layer 13 are partially joined together. Accordingly, when the method for manufacturing the coaxial cable array is implemented, the relative position between the first unit 3 and the second unit 5 is less likely to shift. Also, when the method for manufacturing the coaxial cable array is implemented, it is unnecessary to adjust the relative position between the first unit 3 and the second unit 5. Consequently, the coaxial cable array 117 can be easily manufactured in a short time.

(1B) The first solder layer 9 and the second solder layer 13 are joined at the first joint point 15 and the second joint point 17 aligned along the longitudinal direction L. This configuration further reduces a likelihood of shifting of the relative position between the first unit 3 and the second unit 5.

(1C) In the method for manufacturing the coaxial cable array, the space 94 is expanded by applying a compression force acting in the longitudinal direction L of the solder 1 with ground bar to the solder 1 with ground bar before the plurality of coaxial cables 95 are inserted into the space 94. This configuration further facilitates the insertion of the plurality of coaxial cables 95 into the space 94.

Second Embodiment

1. Difference from First Embodiment

The second embodiment is basically configured in the same manner as the first embodiment, and only difference therebetween will be described below. The same reference numbers as in the first embodiment are attached to the components that are the same as those of the first embodiment. Thus, for those components, the preceding descriptions should be referred to.

In the first embodiment, the first solder layer 9 and the second solder layer 13 are joined at the first joint point 15 and the second joint point 17. Also, the first ground bar 7 and the first solder layer 9 are joined at the first joint point 15 and the second joint point 17. The second ground bar 11 and the second solder layer 13 are joined at the first joint point 15 and the second joint point 17.

Figure 7:
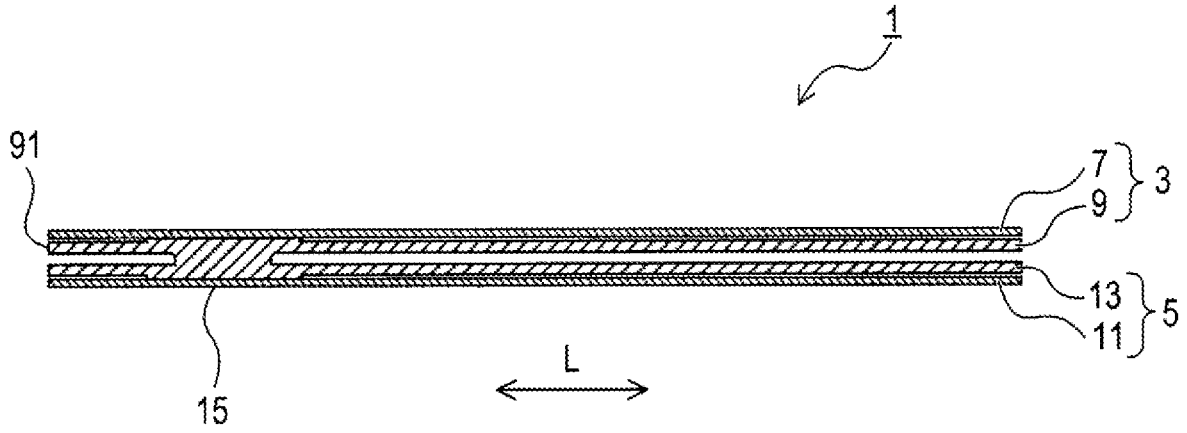
FIG. 7 is a sectional view showing a configuration of a solder 1 with ground bar according to a second embodiment.

Instead, in the second embodiment, the first solder layer 9 and the second solder layer 13 are joined only at the first joint point 15 as shown in FIG. 7, making a difference between the first embodiment and the second embodiment.

Also, the second embodiment having the first ground bar 7 and the first solder layer 9 joined only at the first joint point 15 makes another difference from the first embodiment. Further, the second embodiment differs from the first embodiment in that the second ground bar 11 and the second solder layer 13 are joined only at the first joint point 15 in the second embodiment. The first joint point 15 is positioned closer to the end 91 than a center along the longitudinal direction L.

In the second embodiment, the solder 1 with ground bar may be manufactured by basically the same method as that described in the first embodiment. Nevertheless, the heater 79 included in the production machine 19 is not used but only the heater 77 is used to manufacture the solder 1 with ground bar. The position heated by the heater 77 will be the first joint point 15.

Figure 8:
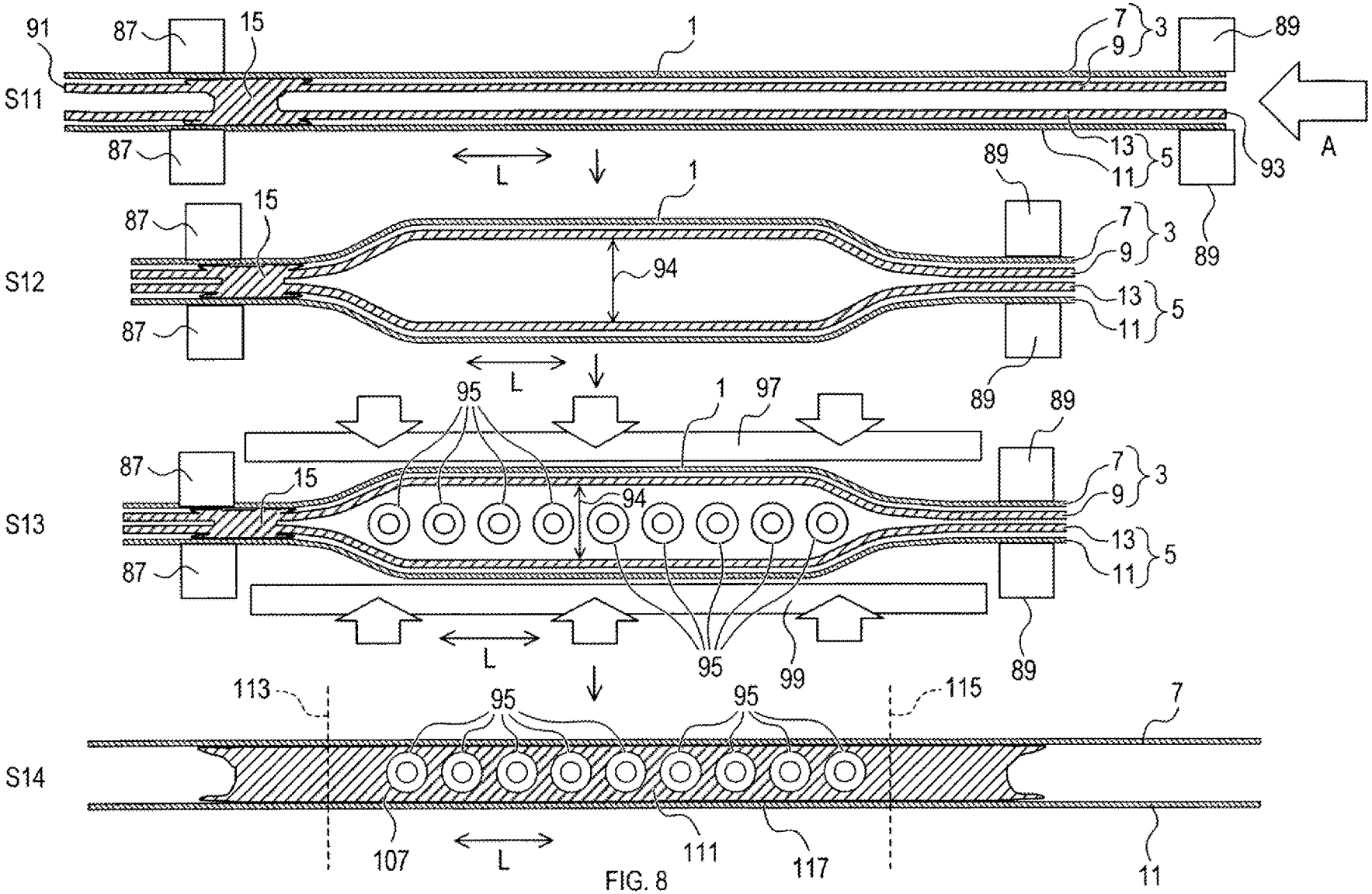
FIG. 8 is a schematic view illustrating a method for manufacturing a coaxial cable array according to the second embodiment.

In the second embodiment, the coaxial cable array 117 may be manufactured by the same method as that described in the first embodiment, as shown in FIG. 8. As shown in S12 and S13 of FIG. 8, even if the second joint point 17 is absent, the space 94 is expanded when the solder 1 with ground bar is applied with a compression force acting in the longitudinal direction L.

2. Effects Obtained from Method for Manufacturing Solder 1 with Ground Bar and Coaxial Cable Array According to the above-detailed second embodiment, the above-described effects (1A) and (1C) of the first embodiment can be obtained.

Third Embodiment

1. Difference from First Embodiment

The third embodiment is basically configured in the same manner as the first embodiment, and only differences therebetween will be described below. The same reference numbers as in the first embodiment are attached to the components that are the same as those of the first embodiment. Thus, those components are to be referred to the preceding descriptions.

In the first embodiment, the first ground bar 7 and the first solder layer 9 are joined at the first joint point 15 and the second joint point 17. Also, the second ground bar 11 and the second solder layer 13 are joined at the first joint point 15 and the second joint point 17.

Figure 9:
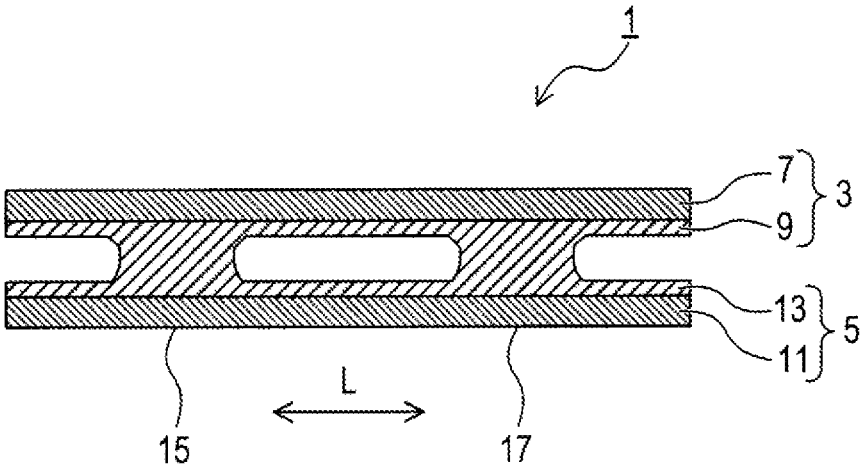
FIG. 9 is a sectional view showing a configuration of a solder 1 with ground bar according to a third embodiment.

Instead, in the third embodiment, an entire surface of the first solder layer 9 is joined to the first ground bar 7, as shown in FIG. 9. An entire surface of the second solder layer 13 is joined to the second ground bar 11.

In the first embodiment, the first solder layer 9 and the second solder layer 13 are formed from the rolled thread solder. In the third embodiment, the first solder layer 9 and the second solder layer 13 are formed using a solder plating method.

In the third embodiment, the solder 1 with ground bar may be produced using a method described below. Using the solder plating method, the first solder layer 9 is formed on one side of the first ground bar 7 to produce the first unit 3. The second solder layer 13 is formed, using the solder plating method, on one side of the second ground bar 11 to produce the second unit 5. A plate material with solder layer may be firstly produced by forming a solder layer on a plate material having a large area using the solder plating method, and the first unit 3 and the second unit 5 may be secondly produced by being cutting out from the plate material with solder layer.

Subsequently, the first unit 3 and the second unit 5 are stacked in such a manner that the first solder layer 9 and the second solder layer 13 face each other. Then, the first joint point 15 and the second joint point 17 are heated and then cooled. During this process, the first solder layer 9 and the second solder layer 13 are joined at the first joint point 15 and the second joint point 17, and the solder 1 with ground bar is produced. The first solder layer 9 and the second solder layer 13 may be joined only at the first joint point 15.

2. Effects Obtained from Method for Manufacturing Solder 1 with Ground Bar and Coaxial Cable Array According to the above-detailed third embodiment, the above-described effects of the first embodiment, and further effects as below can be obtained.

(3A) In the third embodiment, the entire surface of the first solder layer 9 is joined to the first ground bar 7. This configuration inhibits the first solder layer 9 from separating from the first ground bar 7 and moving toward the second solder layer 13. Also, the entire surface of the second solder layer 13 is joined to the second ground bar 11 in the third embodiment. This configuration inhibits the second solder layer 13 from separating from the second ground bar 11 and moving toward the first solder layer 9. It can inhibit the space 94 from being narrowed. This configuration further facilitates the insertion of the plurality of coaxial cables 95 into the space 94.

Other Embodiments

Although some embodiments of the present disclosure have been described above, the present disclosure is not limited to the aforementioned embodiments, but may be implemented in various forms.

(1) The solder 1 with ground bar may comprise three or more joint points for joining the first solder layer 9 and the second solder layer 13.

(2) In the solder 1 with ground bar, joint points for joining the first solder layer 9 and the second solder layer 13 may be partially or entirely aligned along a direction crossing with the longitudinal direction L.

(3) Expanding the space 94 may be implemented by a method described below. First, a space expanding unit is inserted into the space 94. The space expanding unit comprises two separable members. The space expanding unit is made from, for example, two stacked plate-shaped members. Specifically, the space expanding unit comprises, for example, a member having one or more convexes on one side and a member having one or more concaves on one side. When the space expanding unit is inserted into the space 94, the convex(es) of one of the members and the concave(s) of the other member engage with one another. While the convex(es) of one of the members and the concave(s) of the other member engage with one another, the space expanding unit is in a form of, for example, a plate.

Subsequently, the two members that the space expanding unit comprises are separated. One of the two members pushes the first solder layer 9 in a direction away from the second solder layer 13. The other one of the two members pushes the second solder layer 13 in a direction away from the first solder layer 9. Consequently, the space 94 is expanded.

(4) A function performed by a single element in the aforementioned embodiments may be achieved by a plurality of elements, or a function performed by a plurality of elements may be achieved by a single element. Also, a part of a configuration in the aforementioned embodiments may be omitted. Further, at least a part of a configuration in one of the aforementioned embodiments may be added to, or may replace, a configuration in another one of the aforementioned embodiments.

(5) In addition to the above-described solder with ground bar, the present disclosure may be implemented in various forms, such as, any system comprising the subject solder with ground bar, and a method for manufacturing the solder with ground bar.

What is claimed is:

1. A solder with ground bar, comprising:

a first unit including a first ground bar and a first solder layer that is attached to one side of the first ground bar; and a second unit including a second ground bar and a second solder layer that is attached to one side of the second ground bar, wherein the first unit and the second unit are arranged in such a manner that the first solder layer and the second solder layer face each other, wherein a portion of the first solder layer and a portion of the second solder layer are joined together and another portion of the first solder layer and another portion of the second solder layer are not joined together, and wherein the portion of the first solder layer and the portion of the second solder layer not joined together directly face each other.

2. The solder with ground bar according to claim 1, wherein the first solder layer and the second solder layer are joined at one or more joint points aligned along a longitudinal direction of the solder with ground bar.

3. The solder with ground bar according to claim 1, wherein a portion of the first ground bar and a further portion of the first solder layer are joined together and another portion of the first ground bar and yet another portion of the first solder layer are not joined together, and wherein a portion of the second ground bar and a further portion of the second solder layer are joined together and another portion of the second ground bar and yet another portion of the second solder layer are not joined together.

4. The solder with ground bar according to claim 3, wherein the portions of the first ground bar and the first solder layer joined together, the portions of the second ground bar and the second solder layer joined together, and the portions of the first solder layer and the second solder layer joined together are at least partially overlapped with each other in a thickness direction of the solder with ground bar.

5. The solder with ground bar according to claim 1, wherein the portion of the first solder layer and the portion of the second solder layer not joined together extend beyond a range from an end to a center in the longitudinal direction L of the solder with ground bar.

6. The solder with ground bar according to claim 1, wherein the first ground bar and the first solder layer are entirely joined together, and wherein the second ground bar and the second solder layer are entirely joined together.

7. The solder with ground bar according to claim 1, wherein in a width direction of the solder with ground bar, a width of the portion of the first solder layer and the portion of the second solder layer joined together is smaller than a width of the solder with ground bar.

8. A method for manufacturing a coaxial cable array by attaching a ground bar to coaxial cables using a solder with ground bar, wherein the solder with ground bar comprises:

a first unit including a first ground bar and a first solder layer that is attached to one side of the first ground bar, and a second unit including a second ground bar and a second solder layer that is attached to one side of the second ground bar, wherein the first unit and the second unit are arranged in such a manner that the first solder layer and the second solder layer face each other, wherein a portion of the first solder layer and a portion of the second solder layer are joined together and another portion of the first solder layer and another portion of the second solder layer are not joined together, wherein exposed portions of outer conductors of the coaxial cables are inserted between the portion of the first solder layer and the portion of the second solder layer not joined together, and wherein the first solder layer and the second solder layer are molten to join the outer conductors with the ground bar.

9. The method for manufacturing the coaxial cable array according to claim 8, wherein a space between the portion of the first solder layer and the portion of the second solder layer not joined together is expanded by applying a compression force acting in a longitudinal direction L of the solder with ground bar to the solder with ground bar before the coaxial cables are inserted between the portion of the first solder layer and the portion of the second solder layer not joined together.

10. The method for manufacturing the coaxial cable array according to claim 8, wherein before the coaxial cables are inserted between the portion of the first solder layer and the portion of the second solder layer not joined together, a space expanding unit is inserted between the portion of the first solder layer and the portion of the second solder layer not joined together, and the space expanding unit presses the first solder layer and the second solder layer so as to separate the first solder layer and the second solder layer from each other to expand a space between the portion of the first solder layer and the portion of the second solder layer not joined together.

11. A solder with ground bar, comprising:

a first unit including a first ground bar and a first solder layer that is attached to one side of the first ground bar; and a second unit including a second ground bar and a second solder layer that is attached to one side of the second ground bar, wherein the first unit and the second unit are arranged in such a manner that the first solder layer and the second solder layer face each other, wherein a portion of the first solder layer and a portion of the second solder layer are joined together and another portion of the first solder layer and another portion of the second solder layer are not joined together, wherein a portion of the first ground bar and a further portion of the first solder layer are joined together and another portion of the first ground bar and yet another portion of the first solder layer are not joined together, and wherein a portion of the second ground bar and a further portion of the second solder layer are joined together and another portion of the second ground bar and yet another portion of the second solder layer are not joined together.

12. The solder with ground bar according to claim 11, wherein the portions of the first ground bar and the first solder layer joined together, the portions of the second ground bar and the second solder layer joined together, and the portions of the first solder layer and the second solder layer joined together are at least partially overlapped with each other in a thickness direction of the solder with ground bar.

* * * * *